US011530895B1

(12) United States Patent
Chaney

(10) Patent No.: US 11,530,895 B1
(45) Date of Patent: Dec. 20, 2022

(54) BUCKLE ASSEMBLY WITH DUAL FRICTIONAL LEVELS

(71) Applicant: HSG, LLC, Swansboro, NC (US)

(72) Inventor: Daniel Logan Chaney, Morehead City, NC (US)

(73) Assignee: HSG, LLC, Swansboro, NC (US)

( * ) Notice: Subject to any disclaimer, the term of this patent is extended or adjusted under 35 U.S.C. 154(b) by 0 days.

(21) Appl. No.: 17/688,580

(22) Filed: Mar. 7, 2022

Related U.S. Application Data

(60) Provisional application No. 63/192,379, filed on May 24, 2021.

(51) Int. Cl.
*F41C 33/00* (2006.01)
*F41C 23/02* (2006.01)
*A44B 11/06* (2006.01)

(52) U.S. Cl.
CPC ..... *F41C 23/02* (2013.01); *A44B 11/065* (2013.01); *F41C 33/002* (2013.01)

(58) Field of Classification Search
CPC ..... F41C 23/00; F41C 23/04; F41C 33/00; F41C 33/001; F41C 33/002; A44B 11/065; A44B 11/18; Y10S 224/913
See application file for complete search history.

(56) References Cited

U.S. PATENT DOCUMENTS 4,562,945 A * 1/1986 Erlandson ..... F41C 33/002 224/609
5,353,538 A * 10/1994 Hakedal ..... F41C 33/001 224/150
5,426,827 A * 6/1995 Tracy ..... A44B 11/065 24/68 CD
6,068,167 A * 5/2000 Hopson ..... F41C 33/002 224/257
2014/0000073 A1* 1/2014 Hortnagl ..... B60P 7/083 24/70 ST
2014/0203053 A1* 7/2014 Rivas-Schlanger ..... F41C 23/02 224/150

* cited by examiner

*Primary Examiner* — Corey N Skurdal
(74) *Attorney, Agent, or Firm* — NK Patent Law

(57) ABSTRACT

A firearm strap buckle assembly includes an inlet end portion and an outlet end portion. A main tensioner bar is medially located within the buckle assembly and having upward facing surface of a first width and a downward facing surface of a second width greater than the first width. A first supporting tensioner bar is located between the inlet end and the main tensioner bar. A second supporting tensioner bar is located between the main tensioner bar and the outlet end. A first strap path is defined where the strap is positioned downwardly of the main tensioner bar. A second strap path is defined where the strap is positioned upwardly of the main tensioner bar. Frictional forces imparted to the strap when arranged within the first strap path are greater than frictional forces imparted to the strap when arranged within the second path strap.

11 Claims, 9 Drawing Sheets

BUCKLE ASSEMBLY WITH DUAL FRICTIONAL LEVELS

CROSS-REFERENCE TO RELATED APPLICATIONS

This application claims priority to U.S. Provisional Patent Application No. 63/192,379, filed on May 24, 2021, and entitled "Buckle Assembly With Dual Friction Levels," the entire contents of which is incorporated by reference herein.

TECHNICAL FIELD

The invention relates to adjustable webbing, strap, and the like, and more particularly, to a buckle assembly that includes a slider capable of adjusting the length of a webbing or strap and securing the webbing or strap at the desired length.

BACKGROUND

Adjustable webbing, straps, slings, belts, and the like (commonly referred to hereinafter as "strap") are almost universally used on various articles. For example, people typically carry articles such as firearms and rifles by hanging them by a carry strap. A rifle strap helps to carry a rifle on a person's shoulder comfortably for long periods of time. A shooting strap has a loop that can be adjusted. Often a metal slider with moving parts (e.g., in the form of a movable crossbar) is provided for adjusting the length of the strap. Some improved versions of such sliders may often include an automatic locking mechanism, where if a tab is released from manipulation after the opening and closing of the slide fastener, a locking pawl disposed in the slider automatically makes an action to maintain a locked position of the slider, and if the tab is not manipulated, the slider is maintained in a sliding locked state. However, the moving parts of the metal slider can get jammed up due to rust or dust. The moving metal parts may further be cumbersome to operate in extreme hot or extreme cold weather conditions.

Some straps are provided with plastic or metal sliders that do not have any moving parts for adjusting the length of the strap. However, such sliders provide for a single friction level, and some users might find this single friction level to be too low while some other users may find this single friction level to be too high for the application at hand.

Accordingly, opportunities exist for providing solutions to the above-noted shortcomings in the art.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

In some embodiments, the presently disclosed subject matter is directed to a strap buckle assembly. The strap buckle assembly comprises an inlet end portion where a strap is received therein, and an outlet end portion where the strap is received therein. A main tensioner bar is medially located within the buckle assembly and having upward facing surface of a first width and a downward facing surface of a second width greater than the first square area. A first supporting tensioner bar is located between the inlet end and the main tensioner bar. A second supporting tensioner bar is located between the main tensioner bar and the outlet end. A first strap path is defined where the strap is positioned upwardly of the first supporting tensioner, downwardly of the main tensioner bar, and upwardly of the second supporting tensioner. A second strap path is defined where the strap is positioned downwardly of the first supporting tensioner, upwardly of the main tensioner bar, and downwardly of the second supporting tensioner. Frictional forces imparted to the strap when arranged within the first strap path are greater than frictional forces imparted to the strap when arranged within the second path strap.

According to some embodiments, the inlet end portion comprises a strap guide bar defining an aperture for receiving the strap therethrough.

According to some embodiments, the strap buckle assembly further comprises a top bar and a bottom bar.

According to some embodiments, the main tensioner bar, the first supporting tensioner bar, and the first supporting tensioner bar extend between the top bar and the bottom bar.

According to some embodiments the outlet end portion comprises a connection bar adapted for an end of the strap to couple therewith.

According to some embodiments, the connection bar comprises two split bars.

According to some embodiments, the split bars comprise a first split bar extending from a top bar and a second split bar extending from a bottom bar.

According to some embodiments, a gap is provided between the first split bar and the second split bar for inserting a loop formed at the end of the strap through the gap for removably securing the loop to the connection bar.

According to some embodiments, the first surface has a first surface roughness value.

According to some embodiments, the flat surface has a second surface roughness value higher than the first surface roughness value.

According to some embodiments, the main tensioner bar, the first supporting tensioner bar, the first supporting tensioner bar, the top bar, and the bottom bar are formed of a plastic material.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "an object" can include a plurality of such objects, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments+/−20%, in some embodiments+/−10%, in some embodiments+/−5%, in some embodiments+/−1%, in some embodiments+/−0.5%, and in some embodiments+/−0.1%, from the specified amount, as such variations are appropriate in the disclosed packages and methods.

Figure 1:
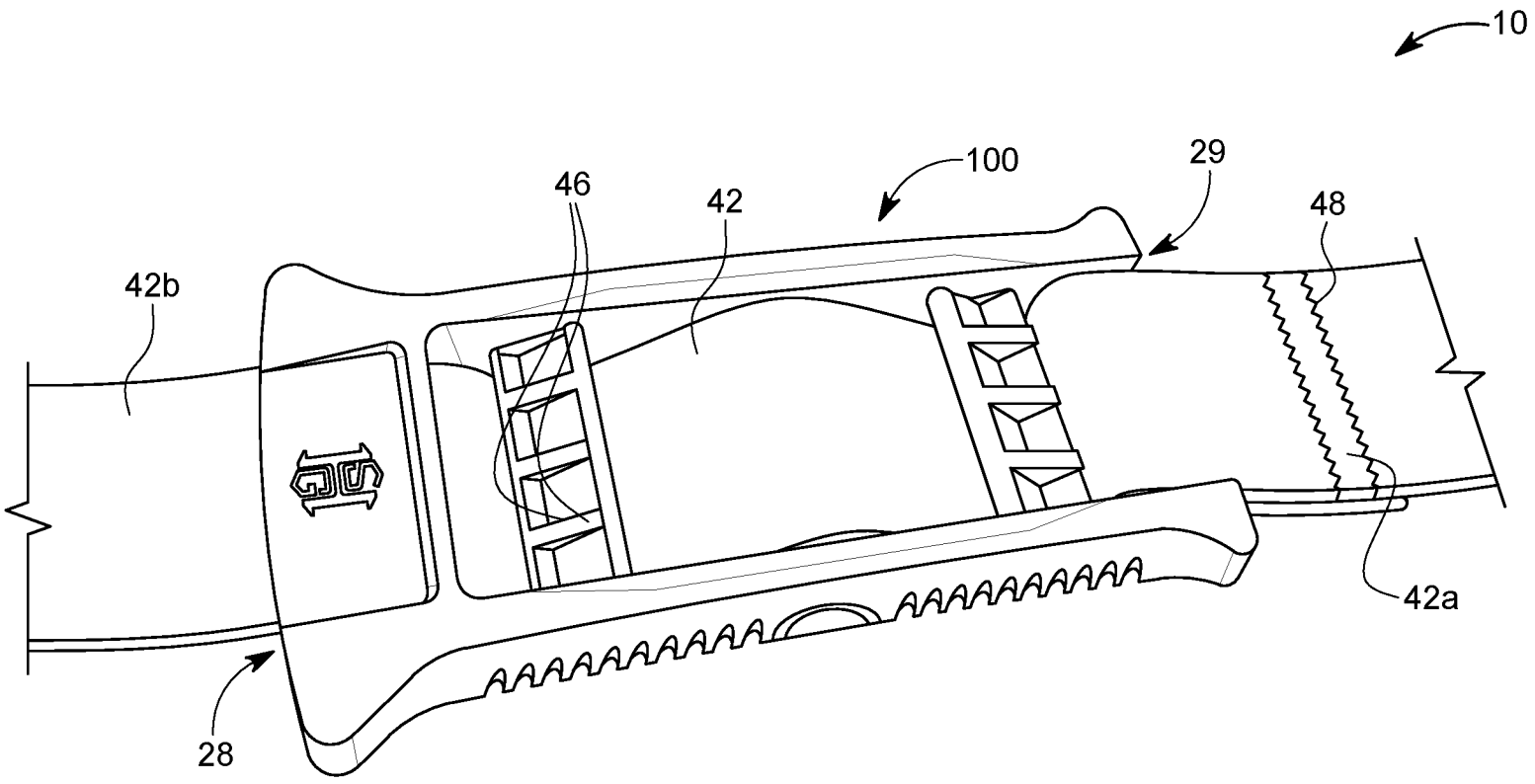
FIG. 1 is side perspective view of a strap buckle assembly, in accordance with some embodiments of the presently disclosed subject matter.
Figure 2:
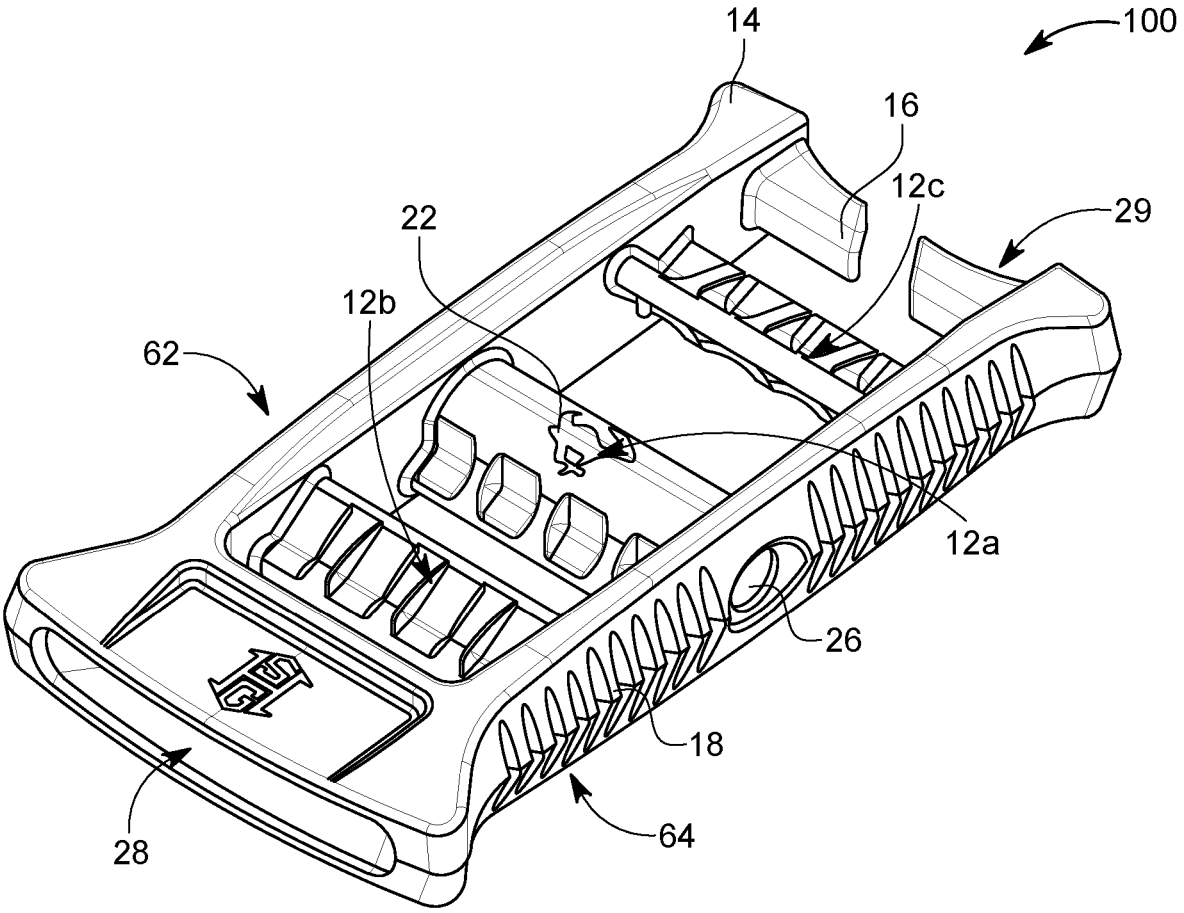
FIG. 2 is a side perspective view of a slider forming part of the strap buckle assembly of FIG. 1, in accordance with some embodiments of the presently disclosed subject matter.
Figure 3A:
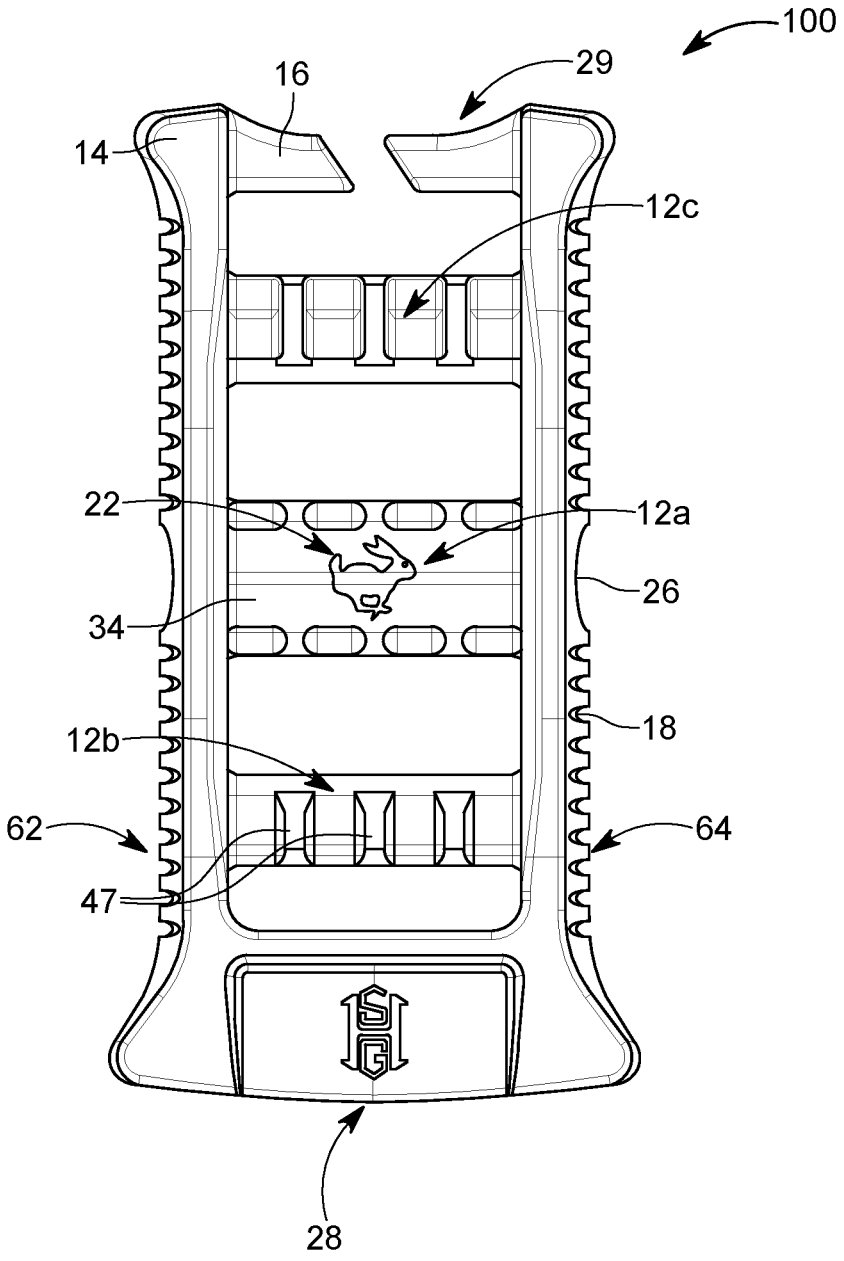
FIG. 3A is a top view.
Figure 3B:
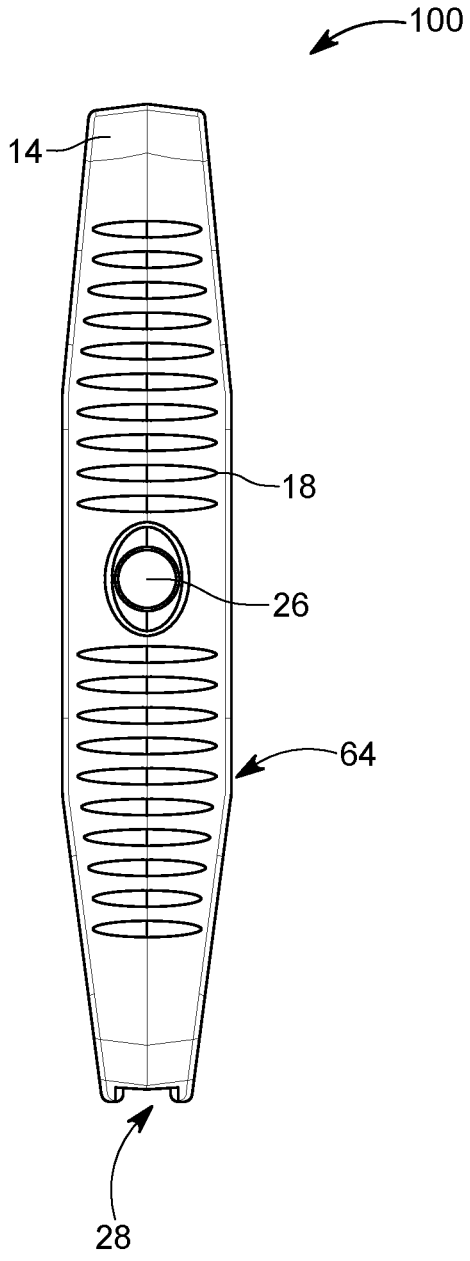
FIG. 3B is a side view.
Figure 3C:
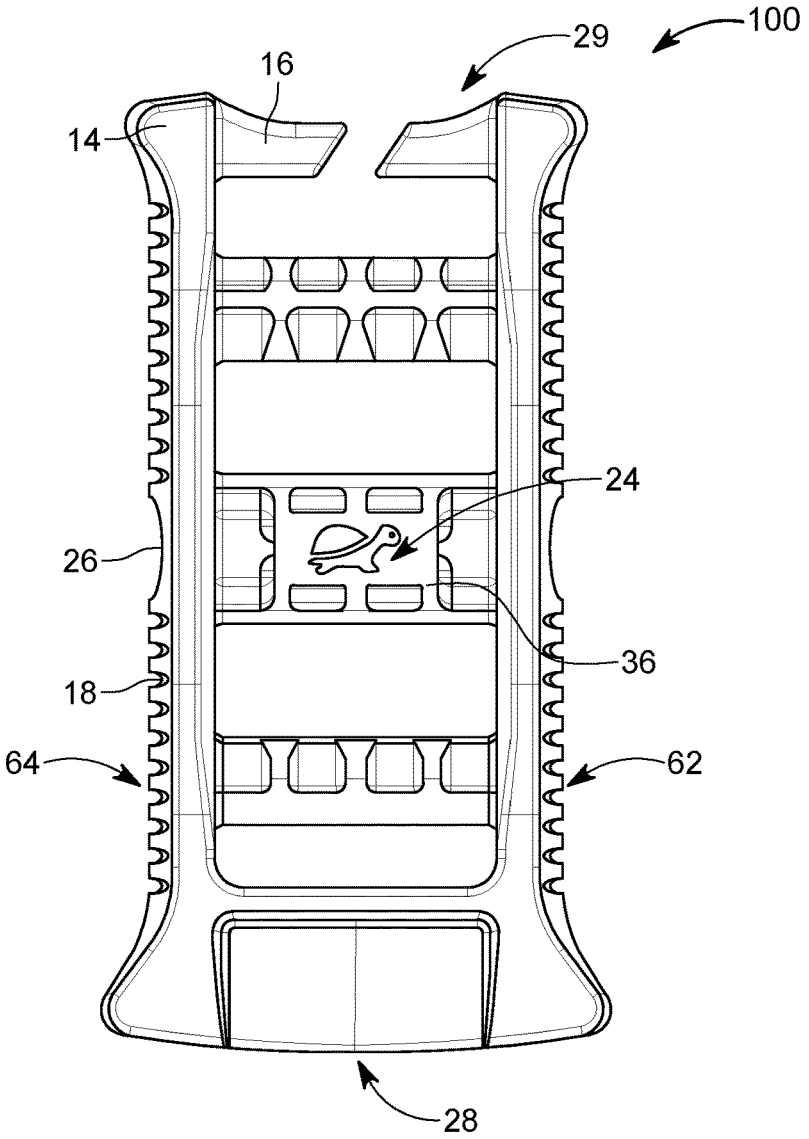
FIG. 3C is bottom view.
Figure 3D:
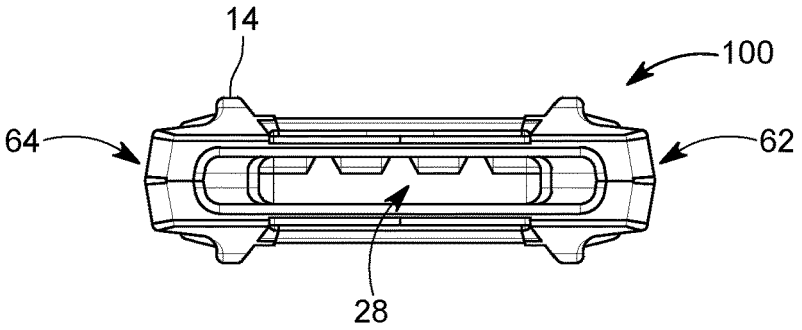
FIG. 3D is a front view of the slider forming part of the strap buckle assembly of FIG. 1, in accordance with some embodiments of the presently disclosed subject matter.
Figure 4:
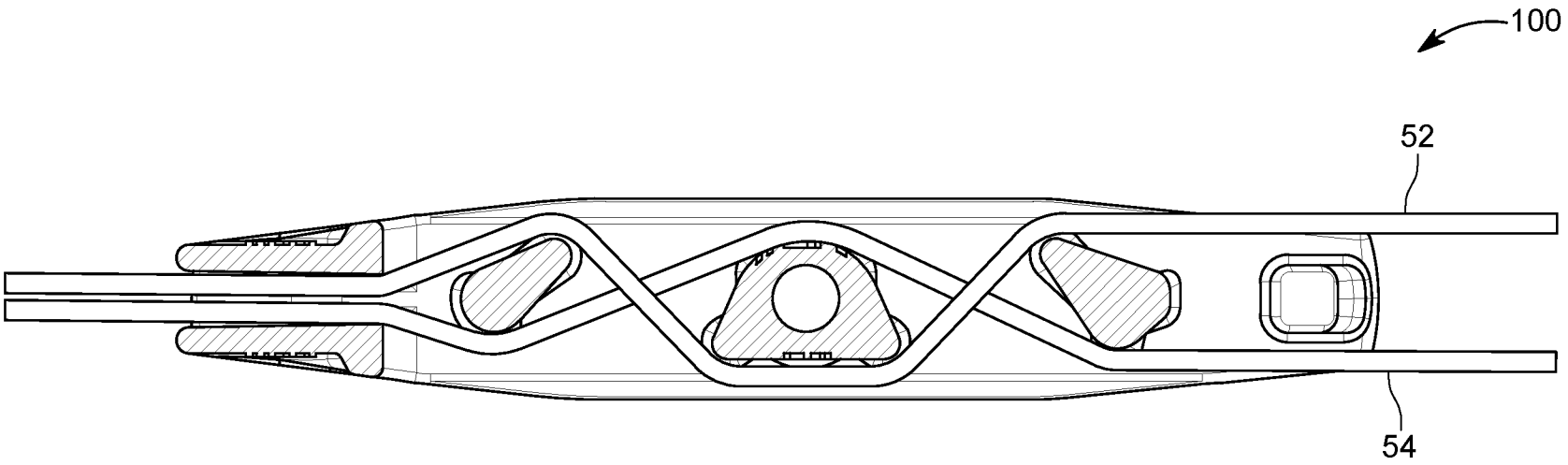
FIG. 4 is a side plan view of the slider with a high friction webbing configuration and a low friction webbing configuration illustrated therein, in accordance with some embodiments of the presently disclosed subject matter.
Figure 5:
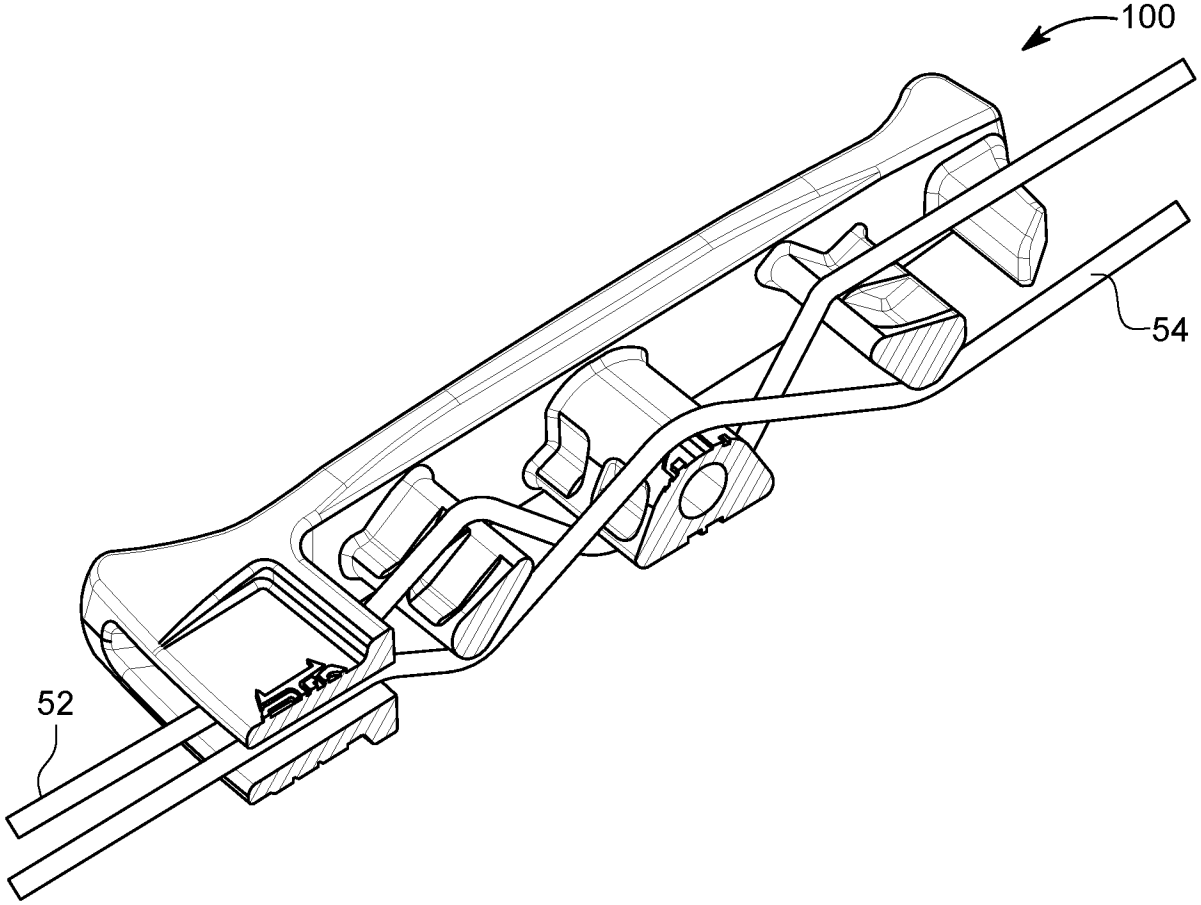
FIG. 5 is a partial side perspective view of the slider with a high friction webbing configuration and a low friction webbing configuration illustrated therein, in accordance with some embodiments of the presently disclosed subject matter.

FIG. 1 through FIG. 5 illustrate various aspects of a strap buckle assembly 10 according to various embodiments of the presently disclosed subject matter. In at least one embodiment, as illustrated, for example, in FIG. 1, strap buckle assembly 10 comprises a slider such as slider 100 and a strap such as strap 42 coupled to slider 100. Slider 100 includes an inlet end portion 28 where a webbing or strap such as strap 42 is received therein. Slider 100 also includes an outlet end portion 29 where strap 42 is received therein. Strap 42 can include a secured end 42*a* and an adjustable free end portion 42*b*. In some embodiments, secured end 42*a* may include stitching 48. In one embodiment, secured end 42*a* may be slid into split bars 16 provided at near outlet end portion 29. FIG. 2 illustrates slider 100. As illustrated in FIG. 2, a main tensioner bar 12*a* is medially located within slider 100 of buckle assembly 10. Main tensioner bar 12*a* has an upward facing surface of a first width such as first surface 34. In one embodiment, the first surface may be a substantially arcuate surface. Main tensioner bar 12*a* further has a downward facing surface such as second surface 36. In one embodiment, second surface 36 may be substantially flat. Slider 100 of buckle assembly 10 further includes a first supporting tensioner bar 12*b* located between inlet end portion 28 and the main tensioner bar 12*a*. Slider 100 further includes a second supporting tensioner bar 12*c* located between the main tensioner bar 12*a* and the outlet end portion 29. As illustrated, for example, in FIG. 4 and FIG. 5, a first strap path 52 is defined where the strap 42 is positioned upwardly of the first supporting tensioner bar 12*b*, downwardly of the main tensioner bar 12*a*, and upwardly of the second supporting tensioner bar 12*c*. A second strap path 54 is defined where the strap 42 is positioned downwardly of the first supporting tensioner bar 12*b*, upwardly of the main tensioner bar 12*a*, and downwardly of the second supporting tensioner bar 12*c*. The frictional forces imparted to the strap 42 when arranged within the first strap path 52 are greater than frictional forces imparted to the strap 42 when arranged within the second strap path 54.

In at least one embodiment, inlet end portion 28 as well outlet end portion 29 may include a flared configuration 14, as illustrated in FIG. 2, to provide for improved gripping of slider 100. Slider 100 can further include knurling 18 to improve gripping of slider 100. Slider 100 can also include pull-tab attachment hole 26 such that a pull tab may be securely inserted therein or otherwise securely attached thereto. In some embodiments, as illustrated in FIG. 2, for example, slider 100 further includes a top bar 62 and a bottom bar 64, with the main tensioner bar, the first supporting tensioner bar, and the first supporting tensioner bar extending between the top bar 62 and the bottom bar 64.

Figure 6:
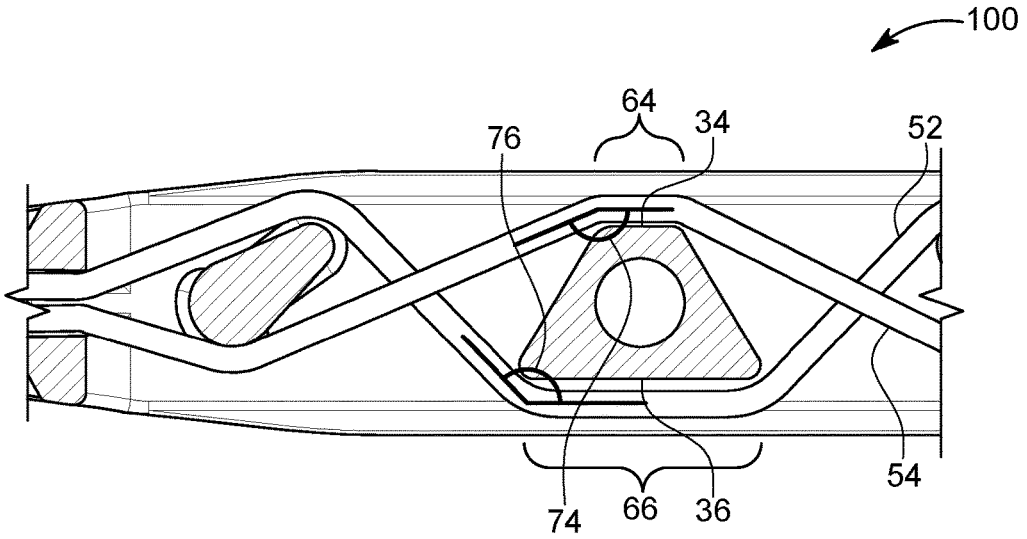
FIG. 6 is a partial side plan view of the slider with a high friction webbing configuration and a low friction webbing configuration illustrated therein, in accordance with some embodiments of the presently disclosed subject matter.
Figure 7:
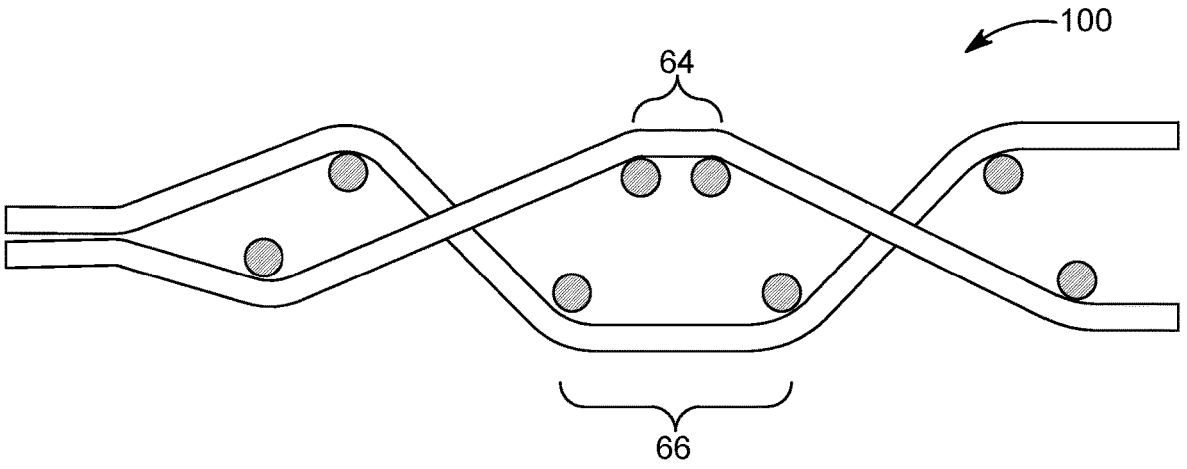
FIG. 7 is a partial side plan view of the slider with a high friction webbing configuration and a low friction webbing configuration illustrated therein, in accordance with some embodiments of the presently disclosed subject matter.

In some embodiments, first surface 34 of main tensioner bar 12*a* can include a low friction indicator 22. Similarly, second surface 36 of main tensioner bar 12*a* can include a high friction indicator 24. First surface 34 of main tensioner bar 12*a* has a first width 64 (see FIG. 6). Similarly, second surface 36 of main tensioner bar 12*a* has a second width 66 (see FIG. 6), which may be greater than the first width 64. Low friction indicator 22 operates to indicate the side over which the strap 42 needs to be positioned in order for the strap 42 to experience lower frictional forces when the strap 42 is subjected to a pulling force, and high friction indicator 24 operates to indicate the side over which the strap 42 needs to positioned in order for the strap 42 to experience higher frictional force as compared to the frictional forces experienced when the strap is positioned over the low friction indicator 22 when the strap 42 is subjected to a pulling force.

In various embodiments, one or more of main tensioner bar 12*a*, first supporting tensioner bar 12*b*, and second supporting tensioner bar 12*c* can embody small projections such as projections 47 on a face thereof. Projections 47 may be tapered and/or slanting. Projections 47 operate to provide a gripping effect on strap 42 placed thereon against sliding displacement in at least one direction over the surface containing projections 47. In one embodiment, projections 47 are configured to apply pressure against interstices of a fabric of strap 42 to thereby securely hold strap 42, resisting against sliding movement over the surface containing projections 47. The strap 42, however, may be readily disengaged from projections 47 by pulling strap 42 over and away from said face in a direction that is the same as the direction of slant of projections 47. Projections 47 are strategically positioned and slanted such as to reduce the possibility of slipping of strap 42 when strap 42 experiences pulling forces in a direction that is parallel to a major axis of strap 42. The projections 47 may have relatively sharp outer edges or tips, or alternately have edges or tips that are blunted—based on the application at hand.

In various embodiments, strap 42 may represent an adjustable strap that embodies a loop with one end of strap 42 such as secured strap end 42*a* secured at or near outlet end portion 29 with the other end of strap that includes free end portion 42*b* passed through inlet end portion 28 and removably secured by means of passing the free end portion 42*b* either through the first strap path 52 for high friction securement or through the second strap path 54 for low friction securement.

According to one embodiment, secured strap end 42*a* is inserted into two split bars 16, and the adjustable free end portion 42*b* is looped through slider 100 either through the first strap path 52 or through the second strap path 54 to complete the length-adjustable loop portion of strap 42. Slider 100 then operates to hold strap 42 in loop form. Any axial tension applied on adjustable free end portion 42*b* creates a pulling or tension force in the segment of strap 46 that is lying against first surface 34 or against second surface 36 (depending on whether strap 46 is strung along first strap path 52, i.e., high friction configuration, or along second strap path 54, i.e., low friction configuration). In one embodiment, strap 42 strung along second strap path 54 may make a first angle 74 with an edge of first surface 34. Similarly, in one embodiment, strap 42 strung along first strap path 52 may make a second angle 76 with an edge of second surface 36.

Figure 8:
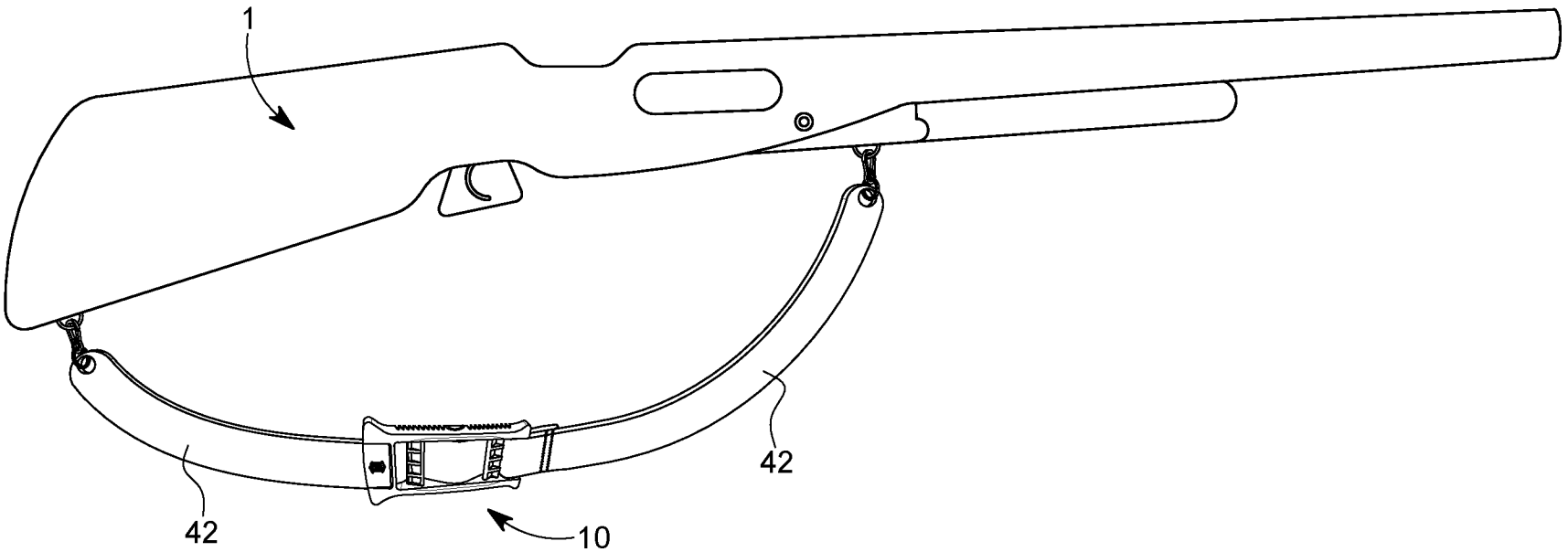
FIG. 8 is a side view of the slider on a sling associated with a firearm accessory, disclosed in this exemplary embodiment as a rifle.

FIG. 8 illustrates the strap buckle 10 is illustrated along a strap 42, which is operatively coupled with a firearm 1. The strap buckle 10 can be oriented within the high friction mode or the low friction mode, depending on the user preference and/or type of gear being worked with. Any firearm or firearm accessory can be used.

In various embodiments, slider 100 can be used with articles such as webbing, fasteners strap, dog collar harness, nylon webbing, camping bag belt, suitcase, backpack, sports equipment, and pet products. In various embodiments, the slider may be composed of materials such as polyoxymethylene (polyformaldehyde). Alternate materials of construction may include one or more of the following: steel, aluminum, titanium, and/or other metals, as well as various alloys and composites thereof, glass-hardened polymers, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset sheet materials, and/or various combinations of the foregoing. Various embodiments of the slider may be formed of a plastic material, and the slider may comprise thermoplastic polymers, thermosetting polymers, or similar other materials. In at least embodiment, the slider is formed by molding technics. In at least embodiment, the slider is composed of a material such as iron, with nickel plated on the surface to prevent rust or corrosions. Thus, it should be understood that the material or materials used to form the slider is a design choice based on the desired appearance and/or functionality of the slider.

In some embodiments, the strap may be used for attachment to a chest, ankle, leg, shoulder, or other harness or band, or for otherwise securing an article attached to the strap to a user or the user's apparel. It should be appreciated that the slider as described can be configured in any desired size, depending on the size of the item to be moved. For example, the slider can have a length and/or height of about 3-6 inches (e.g., 3, 3.25, 3.5, 3.75, 4, 4.25, 4.5, 4.75, 5, 5.25, 5.5, 5.75, or 6 inches). In one embodiment, the slider is approximately 25 mm/1 inch in inner length and 3 mm/0.12 inch in line diameter and may accommodate a 1-inch-wide webbing or strap. However, the presently disclosed subject matter is not limited and can be configured to be larger or smaller than the range given above.

The strap buckle assembly as disclosed herein provides for two levels of friction. In combat situations, there is a need to quickly slacken the strap carrying the gun in order for a soldier to quickly get the gun ready for firing; the second strap path 54 (i.e., the low friction configuration) can be used for such situations. In other situations, for example, when a fellow comrade is wounded, a soldier carrying the wounded comrade may not want the gun strap to get loosened inadvertently; the first strap path 52 (i.e., the high friction configuration) can be used for such situations.

The use of the strap buckle assembly as disclosed herein is not limited for the carriage of guns and firearms and can be used for any other suitable applications that may benefit from the characteristics described herein or that utilizes a webbing attachment including, cameras, ID tags, duffle bags, handbags, carry bags, backpacks, and similar other items. The strap may be made of leather, nylon or similar other materials used for making straps and webbings. The slider can be flat and having a rectangular, square, triangular, circular, or similar other suitable shape. The embodiments provided herein provide a slider that meets safety requirements, is composed of relatively few operating parts, provides for a firm and secure latching effect, and yet permits quick release when required.

Some existing metal bucket assemblies may include metal hardware with two moving parts, along with a spring-loaded cam piece and teeth to catch the strap. Some other existing bucket assemblies that do not include moving parts may be formed of metal or plastic; however, the non-moving aspect provides for just one level of friction, and otherwise precludes the ability to adjust the level of friction offered. Existing bucket assemblies do not provide for adjustability of friction in the manner provided by the embodiments disclosed herein. Embodiments disclosed herein may advantageously overcome such shortcomings.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

These and other changes can be made to the disclosure in light of the Detailed Description. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

What is claimed is:

1. A firearm sling with a strap buckle assembly comprising:

an inlet end portion where a strap is received therein;

an outlet end portion where the strap is received therein;

a main tensioner bar medially located within the buckle assembly and having upward facing surface of a first width and a downward facing surface of a second width greater than the first width;

a first supporting tensioner bar located between the inlet end and the main tensioner bar;

a second supporting tensioner bar located between the main tensioner bar and the outlet end, wherein, the firearm sling has a first mode of operation in which a first strap path is defined where the strap is positioned upwardly of the first supporting tensioner, downwardly of the main tensioner bar, and upwardly of the second supporting tensioner and the strap is arranged in the first strap path, wherein, the firearm sling has a second mode of operation in which a second strap path is defined where the strap is positioned downwardly of the first supporting tensioner, upwardly of the main tensioner bar, and downwardly of the second supporting tensioner and the strap is arranged in the second strap path, wherein frictional forces imparted to the strap when arranged within the first strap path are greater than frictional forces imparted to the strap when arranged within the second path strap, wherein the firearm sling is operatively coupled to firearm at opposing ends of the sling.

2. The firearm sling of claim 1, wherein the inlet end portion comprises a strap guide bar defining an aperture for receiving the strap therethrough.

3. The firearm sling of claim 1, further comprising a top bar and a bottom bar.

4. The firearm sling of claim 3, wherein the main tensioner bar, the first supporting tensioner bar, and the first supporting tensioner bar extend between the top bar and the bottom bar.

5. The firearm sling of claim 4, wherein the main tensioner bar, the first supporting tensioner bar, the first supporting tensioner bar, the top bar, and the bottom bar are formed of a plastic material.

6. The firearm sling of claim 1, wherein the outlet end portion comprises a connection bar adapted for an end of the strap to couple therewith.

7. The firearm sling of claim 6, wherein the connection bar comprises two split bars.

8. The firearm sling of claim 7, wherein the split bars comprise a first split bar extending from a top bar and a second split bar extending from a bottom bar.

9. The firearm sling of claim 8, wherein a gap is provided between the first split bar and the second split bar for inserting a loop formed at the end of the strap through the gap for removably securing the loop to the connection bar.

10. The firearm sling of claim 1, wherein the upward facing first surface has a first surface roughness value.

11. The firearm sling of claim 10, wherein the downward facing second surface has a second surface roughness value higher than the first surface roughness value.

* * * * *